US011260444B2

(12) United States Patent
Xu et al.

(10) Patent No.: US 11,260,444 B2
(45) Date of Patent: Mar. 1, 2022

(54) FORMING DEVICE AND METHOD FOR LARGE THIN-WALLED PART WITH CURVED SURFACE

(71) Applicant: Harbin Institute of Technology, Harbin (CN)

(72) Inventors: Yongchao Xu, Harbin (CN); Shijian Yuan, Harbin (CN)

(73) Assignee: HARBIN INSTITUTE OF TECHNOLOGY, Harbin (CN)

( * ) Notice: Subject to any disclaimer, the term of this patent is extended or adjusted under 35 U.S.C. 154(b) by 11 days.

(21) Appl. No.: 16/743,621

(22) Filed: Jan. 15, 2020

(65) Prior Publication Data

US 2021/0046534 A1 Feb. 18, 2021

(30) Foreign Application Priority Data

Aug. 14, 2019 (CN) ..... 201910747920.2

(51) Int. Cl.

| | |
|---|---|
| ***B21D 22/22*** | (2006.01) |
| ***B21D 22/06*** | (2006.01) |
| ***B21D 22/24*** | (2006.01) |
| ***B21D 24/08*** | (2006.01) |
| ***B21D 37/10*** | (2006.01) |
| ***B21D 43/00*** | (2006.01) |
| ***B21D 11/22*** | (2006.01) |

(52) U.S. Cl.

CPC ..... *B21D 22/22* (2013.01); *B21D 22/06* (2013.01); *B21D 22/24* (2013.01); *B21D 24/08* (2013.01); *B21D 37/10* (2013.01); *B21D 43/003* (2013.01); *B21D 11/22* (2013.01)

(58) Field of Classification Search

CPC ..... B21D 22/06; B21D 22/20; B21D 22/205; B21D 22/22; B21D 22/24; B21D 22/26; B21D 22/30; B21D 37/04; B21D 37/08

USPC ..... 72/413

See application file for complete search history.

(56) References Cited

U.S. PATENT DOCUMENTS

| | | | | |
|---|---|---|---|---|
| 3,252,315 A * | 5/1966 | Muench | ..... | B21D 53/32 72/328 |
| 2019/0160517 A1* | 5/2019 | Turner | ..... | B21D 22/06 |

FOREIGN PATENT DOCUMENTS

| | | | |
|---|---|---|---|
| CN | 1554497 A | * | 12/2004 |
| CN | 109175051 A | * | 1/2019 |
| JP | 01133622 A | * | 5/1989 |
| JP | 08090100 A | * | 4/1996 |

* cited by examiner

*Primary Examiner* — Jessica Cahill
*Assistant Examiner* — Jared O Brown
(74) *Attorney, Agent, or Firm* — Wenderoth, Lind & Ponack, L.L.P.

(57) ABSTRACT

The present invention discloses a forming device for a large thin-walled part with a curved surface, which includes a punch, a blank holder, a die, a lower die plate, a first annular sleeve and second annular sleeves. The first annular sleeve is connected with first driving oil cylinders. An inner diameter of the die is greater than an outer diameter of the punch. The first annular sleeve is arranged in a gap between the punch and the die. The second annular sleeve is arranged at the bottom of the punch. The first annular sleeve is arranged outside the second annular sleeve. The second annular sleeve is connected with second driving oil cylinders. The first driving oil cylinders and the second driving oil cylinders are connected with a hydraulic system.

15 Claims, 1 Drawing Sheet

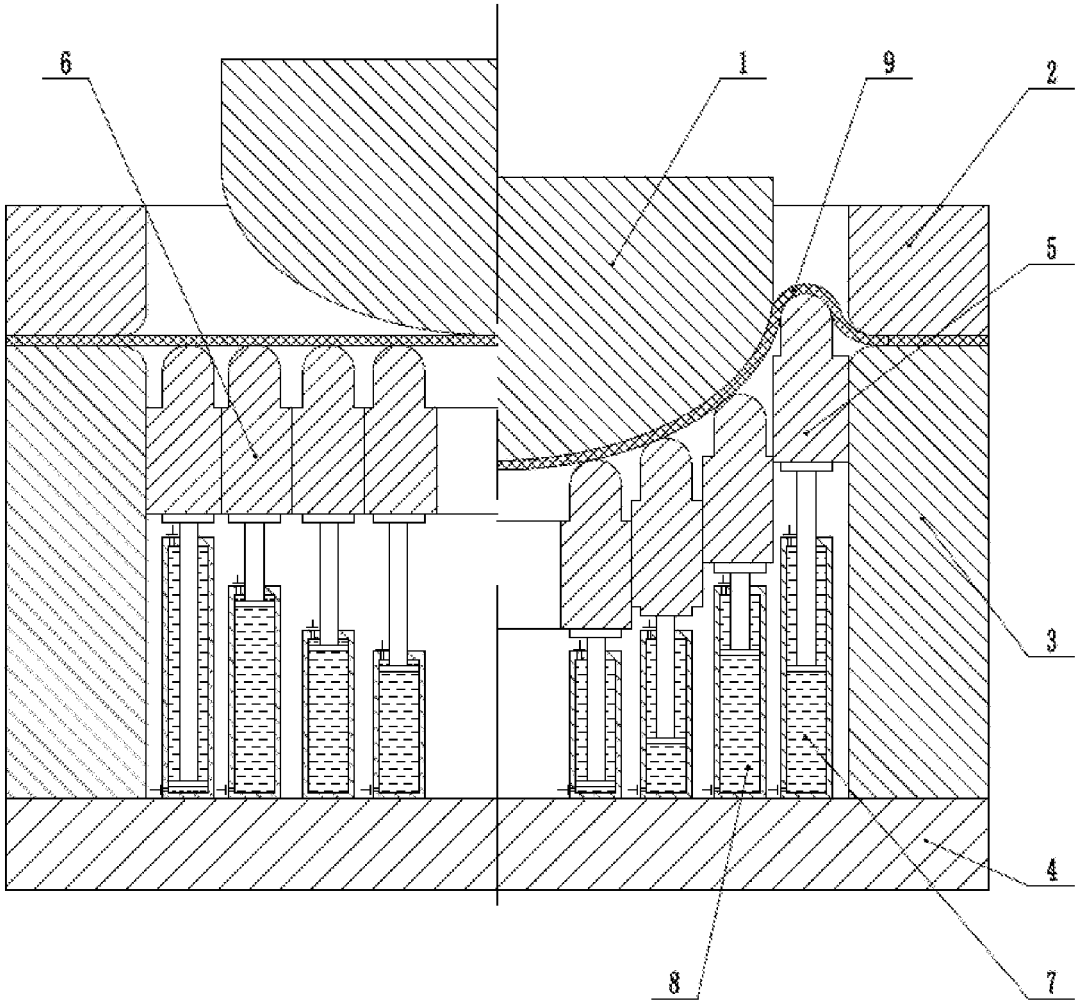
6
1
9
2
5
3
4
8
7

FORMING DEVICE AND METHOD FOR LARGE THIN-WALLED PART WITH CURVED SURFACE

TECHNICAL FIELD

The present invention relates to the technical field of manufacture of a thin-walled part with a curved surface, and in particular to a forming device and method for a large thin-walled part with a curved surface.

BACKGROUND

Heads and a cylinder are welded together to form a main body structure of a pressure vessel widely applied in the aerospace and petrochemical fields. The head generally is in a shape of a spherical or semi-ellipsoidal curved surface. A large part with a curved surface generally has a diameter of more than 3000 mm and is a complex sheet part. The head is generally manufactured by a thick plate spinning technique. There are also a series of problems: first, easy wrinkling, that is, for a ϕ3000 mm part with a curved surface, if its thickness is less than 30 mm, wrinkling is most likely to occur, and subsequent machining and chemical milling are required to remove the wrinkling; second, difficulty in accurate control of heating during spinning, thereby causing reduction of structure properties and influencing reliability; third, low spinning efficiency, complex loading path, long processing cycle, poor size accuracy, and high requirements of a large high-accuracy part on rigidity and accuracy of a spinning device; fourth, limited access to high-end spinning devices required for the manufacture of thin-walled parts with curved surfaces since some countries such as German strictly prohibits the export of those high-end devices.

Hydromechanical deep drawing can be used to avoid wrinkling when a part with a complex curved surface is formed by an ultra-thin-walled heavy sheet. However, a specimen has a large overall size, a thick ultra-thin wall and a complex profile, so a high liquid chamber pressure is required during hydromechanical deep drawing. Additionally, reaction of the liquid chamber pressure may cause a large equipment tonnage; for example, a 3 m head requires a deep drawing force about 12000 tons, and a 5 m head requires a deep drawing force about 30000 tons. High equipment costs and large equipment tonnage become bottlenecks of the hydromechanical deep drawing process of the large thin-walled part with a curved surface.

Therefore, how to prevent a suspended area of the large thin-walled part with a curved surface from wrinkling in the prior art needs to be urgently solved by persons skilled in the art.

SUMMARY

An objective of the present invention is to provide a forming device and method for a large thin-walled part with a curved surface to prevent a suspended area of a large thin-walled part with a curved surface from wrinkling and improve forming quality.

To achieve the above purpose, the present invention provides the following technical solution: A forming device for a large thin-walled part with a curved surface includes a punch, a blank holder, a die, a lower die plate, a first annular sleeve and second annular sleeves, in which the die and the blank holder can be connected with a press, and the press can drive the punch and the blank holder to move up and down;

the blank holder is arranged at the top of the die, the lower die plate is arranged at the bottom of the die, and the first annular sleeve is arranged in a cavity of the die; the first annular sleeve is connected with first driving oil cylinders, and the first driving oil cylinders can drive the first annular sleeve to move up and down; an inner diameter of the die is greater than an outer diameter of the punch; the first annular sleeve is arranged in an gap between the punch and the die; the second annular sleeve is arranged at the bottom of the punch; the first annular sleeve is arranged outside the second annular sleeve; the second annular sleeve is connected with second driving oil cylinders, and the second driving oil cylinders can drive the second annular sleeve to move up and down; the first driving oil cylinders and the second driving oil cylinders are connected with a hydraulic system; the surfaces of the first annular sleeve and the second annular sleeve towards the punch are arc-shaped.

Preferably, there are three second annular sleeves, and the three second annular sleeves are coaxially arranged with different radii.

Preferably, the number of the first driving oil cylinders and the second driving oil cylinders can be set as required; two of the first driving oil cylinders are symmetrically arranged relative to the axis of the first annular sleeve; two of the second driving oil cylinders are symmetrically arranged relative to the axis of the second annular sleeve.

Preferably, the first driving oil cylinders and the second driving oil cylinders are arranged on the lower die plate.

Preferably, the cross section of the first annular sleeve is similar to that of the second annular sleeve.

Preferably, a contact area of a blank holder and the sheet blank, or a contact area of the die and a sheet blank are filleted.

The present invention further provides a forming method for a large thin-walled part with a curved surface, including the following steps:

step 1, a sheet blank is placed on an upper surface of the die, and the top of the first annular sleeve and the top of the second annular sleeves are pushed against the sheet blank;

step 2, the press drives the connected blank holder to move downwards and applies an initial blank holding force;

step 3, the press drives the punch to move downwards, and the punch stops moving after being in contact with the sheet blank;

step 4, with the hydraulic system, the first driving oil cylinders and the second driving oil cylinders push the first annular sleeve and the second annular sleeves upwards, and force the sheet blank to deform;

step 5, the press drives the punch to move downwards, the sheet blank deforms downwards, and the second annular sleeves forcedly move downwards;

step 6, the punch drives the sheet blank to move downwards until the sheet blank is in contact with the first annular sleeve; the hydraulic system increases the pressure of a lower cavity of the first driving oil cylinder such that the first annular sleeve pushes the sheet blank to deform upwards, and the sheet blank at the suspended area is leaned on the punch to form a deep drawbead; therefore, the wrinkling is prevented in the suspended area;

step 7, after deep drawing is completed, the hydraulic system controls the first driving oil cylinders and the second driving oil cylinders such that the first annular sleeve and the second annular sleeves return to the initial positions; a top surface of the first annular sleeve and top surfaces of the second annular sleeves are leveled with a top surface of the die.

Preferably, the press drives the blank holder to apply an initial blank holding force to the sheet blank, and a unit blank holding force on a pressing area is in the range of 1-2 MPa.

The present invention achieves the following technical effects compared with the prior art: a forming device for a large thin-walled part with a curved surface includes a punch, a blank holder, a die, a lower die plate, a first annular sleeve and second annular sleeves. The punch and the blank holder can be connected with a press, and the press can drive the punch and the blank holder to move up and down. The blank holder is arranged at the top of the die, the lower die plate is arranged at the bottom of the die, and the first annular sleeve is arranged in a cavity of the die. The first annular sleeve is connected with first driving oil cylinders, and the first driving oil cylinders can drive the first annular sleeve to move up and down. An inner diameter of the die is greater than an outer diameter of the punch. The first annular sleeve is arranged in a gap between the punch and the die. The second annular sleeve is arranged at the bottom of the die. The first annular sleeve is arranged outside the second annular sleeve. The second annular sleeve is connected with second driving oil cylinders, and the second driving oil cylinders can drive the second annular sleeve to move up and down. The first driving oil cylinders and the second driving oil cylinders are connected with a hydraulic system. One surface of the first annular sleeve and one surface of the second annular sleeve towards the punch are arc-shaped. The present invention further provides a forming method for a large thin-walled part with a curved surface. By utilizing the above forming device, a deep drawbead is formed in a suspended area of a deformed sheet blank so as to prevent from wrinkling.

BRIEF DESCRIPTION OF THE DRAWINGS

To describe the technical solutions in the embodiments of the present invention or in the prior art more clearly, the following briefly introduces the accompanying drawings required for describing the embodiments. Apparently, the accompanying drawings in the following description show merely some embodiments of the present invention, and a person of ordinary skill in the art may still derive other accompanying drawings from these accompanying drawings without creative efforts.

FIG. 1 is a schematic diagram showing a sectional structure of a forming device for a large thin-walled part with a curved surface in the present invention.

In the drawing: 1—punch, 2—blank holder, 3—die, 4—lower die plate, 5—first annular sleeve, 6—second annular sleeve, 7—first driving oil cylinder, 8—second driving oil cylinder, and 9—sheet blank.

DETAILED DESCRIPTION

The following clearly and completely describes the technical solutions in the embodiments of the present invention with reference to accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

An objective of the present invention is to provide a forming device and method for a large thin-walled part with a curved surface to solve the problem in the prior art, prevent from wrinkling at a suspended area of a large thin-walled part with a curved surface and improve forming quality.

In order to make the above objects, features, and advantages of the present invention more apparent, the present invention will be further described in detail in connection with the accompanying drawings and the detailed description.

Referring to FIG. 1, FIG. 1 is a schematic diagram showing a sectional structure of a forming device for a large thin-walled part with a curved surface in the present invention.

The present invention provides a forming device for a large thin-walled part with a curved surface, which includes a punch 1, a blank holder 2, a die 3, a lower die plate 4, a first annular sleeve 5 and second annular sleeves 6. The punch 1 and the blank holder 2 can be connected with a press, and the press can drive the punch 1 and the blank holder 2 to move up and down. The blank holder 2 is arranged at the top of the die 3, the lower die plate 4 is arranged at the bottom of the die 3, and the first annular sleeve 5 is arranged in a cavity of the die 3. The first annular sleeve 5 is connected with first driving oil cylinders 7, and the first driving oil cylinders 7 can drive the first annular sleeve 5 to move up and down. An inner diameter of the die 3 is greater than an outer diameter of the punch 1. The first annular sleeve 5 is arranged in a gap between the punch 1 and the die 3. The second annular sleeve 6 is arranged at the bottom of the punch 1. The first annular sleeve 5 is arranged outside the second annular sleeve 6. The second annular sleeve 6 is connected with second driving oil cylinders 8, and the second driving oil cylinders 8 can drive the second annular sleeve 6 to move up and down. The first driving oil cylinders 7 and the second driving oil cylinders 8 are connected with a hydraulic system. One surface of the first annular sleeve 5 and one surface of the second annular sleeve 6 towards the punch 1 are arc-shaped.

When the forming device of the present invention is used for forming a thin-walled part with a curved surface, the first annular sleeve 5 and the second annular sleeve 6 are utilized. During drawing, the first annular sleeve 5 in the gap between the punch 1 and the die 3 moves upwards so as to form a deep drawbead in a suspended area of a deformed sheet blank. Therefore, first, local wrinkling of the suspended area is prevented; second, deep drawing formation of the large thin-walled part with a curved surface is achieved; third, hydraulic loading of integral hydromechanical deep drawing are canceled, avoiding a great acting force; fourth, equipment tonnage is remarkably reduced. Additionally, the size and the number of the first annular sleeve 5 can be adjusted according to the size of the suspended area of the part with a curved surface to improve adaptability of the device.

In the embodiment, there are three second annular sleeves 6, and the three second annular sleeves 6 have a common axis and have different radii. The diameters of the three second annular sleeves 6 are gradually reduced, and the three second annular sleeves 6 are nested one by one. The interval is formed between arc-shaped surfaces of the first annular sleeve 5 and the whole three second annular. Ends, close to the lower die plate 4, of the first annular sleeve 5 and the three second annular sleeves 6 abut against each other and can relatively slide. During actual production, the number of the second annular sleeves 6 can be set according to specific situations such as deformation requirements, specifications of the parts with a curved surface, etc.

To improve stress uniformity of the first annular sleeve 5 and the second annular sleeves 6, the number of the first driving oil cylinders 7 and the second driving oil cylinders 8 can be set as required. The first driving oil cylinders 7 are symmetrically arranged relative to the axis of the first annular sleeve 5. The second driving oil cylinders 8 are symmetrically arranged relative to the axis of the second annular sleeve 6.

Specifically, the first driving oil cylinders 7 and the second driving oil cylinders 8 are arranged on the lower die plate 4. The lower die plate 4 provides mounting foundations for the first driving oil cylinders 7 and the second driving oil cylinders 8 to improve integral stability of the device.

In the embodiment, a shape of an axial section of the first annular sleeve 5 is consistent with a shape of an axial section of the second annular sleeve 6.

More specifically, a contact area of the blank holder 2 and a sheet blank, or a contact area of the die 3 and a sheet blank are filleted, to avoid scratching the sheet blank and to improve the forming quality.

The present invention further provides a forming method for a large thin-walled part with a curved surface. The following explains and describes a specific forming process of a part with a curved surface, where the inner contour of the large thin-walled complex part with a curved surface is semi-ellipsoidal, and a generatrix equation is $$y = \frac{1}{1.6}\sqrt{1669^2 - x^2}.$$

The sheet material is 2219 aluminum alloy, the thickness is 10 mm, a profile of a deep drawing punch 1 is a semi-ellipsoidal surface, and the generatrix equation is $$y = \frac{1}{1.6}\sqrt{1669^2 - x^2}.$$

The forming method includes the following steps:

step 1, the sheet blank is placed on an upper surface of the punch 3, and the top of the first annular sleeve 5 and the tops of the second annular sleeves 6 abut against the sheet blank;

step 2, the press drives the connected blank holder 2 to move downwards to press the sheet blank and apply an initial blank holding force, where a unit blank holding force on a pressing area is in the range of 1.5 MPa;

step 3, the press drives the punch 1 to move downwards, where the punch stops moving after being in contact with the sheet blank;

step 4, with the hydraulic system pressure, first driving oil cylinders 7 and the second driving oil cylinders 8 generate a pushing force, where the first annular sleeve 5 and the second annular sleeves 6 are pushed to support the sheet blank such that the blank sheet deforms upwards, where the deformation height is about 20 mm over the upper surface of the die 3;

step 5, the press drives the punch 1 to move downwards such that the sheet blank deforms downwards and the second annular sleeves 6 forcedly move downwards;

step 6, the punch 1 drives the sheet blank to move downwards until the sheet blank is in contact with the first annular sleeve 5, where the hydraulic system increases the pressure of a lower cavity of the first driving oil cylinder 7 such that the first annular sleeve 5 pushes the sheet blank to deform upwards over about 50 mm the upper surface of the die 3; the sheet blank of the suspended area is leaned on the punch 1 to form a deep drawbead so as to prevent from wrinkling in the suspended area;

step 7, after deep drawing is completed, the hydraulic system controls the first driving oil cylinders 7 and the second driving oil cylinders 8 to reset the first annular sleeve 5 and the second annular sleeves 6 to their initial positions, where a top surface of the first annular sleeve 5 and top surfaces of the second annular sleeves 6 are leveled with a top surface of the die 3.

Several examples are used for illustration of the principles and implementation methods of the present invention. The description of the embodiments is used to help illustrate the method and its core principles of the present invention. In addition, those skilled in the art can make various modifications in terms of specific embodiments and scope of application in accordance with the ideas of the present invention. In conclusion, the content of this specification shall not be construed as a limitation to the present invention.

What is claimed is:

1. A forming device for a large thin-walled part with a curved surface, comprising a punch, a blank holder, a die, a lower die plate, a first annular sleeve and second annular sleeves, wherein the punch and the blank holder can be connected with a press, and the press can drive the punch and the blank holder to move up and down; the blank holder is arranged at a top of the die, the lower die plate is arranged at a bottom of the die, and the first annular sleeve is arranged in a cavity of the die; the first annular sleeve is connected with first driving oil cylinders, and the first driving oil cylinders can drive the first annular sleeve to move up and down; an inner diameter of the die is greater than an outer diameter of the punch; the first annular sleeve is wholly arranged in a gap between a first side of the punch and a first side of the die, the first side extends in an axial direction of the punch, and the first side of the die side is a wall of the cavity of the die and extends in a height direction of the die; the second annular sleeves are arranged below the punch; the first annular sleeve is arranged outside the second annular sleeves; each of the second annular sleeve is connected with second driving oil cylinders, and the second driving oil cylinders can drive the second annular sleeves to move up and down; the first driving oil cylinders and the second driving oil cylinders are connected with a hydraulic system; one surface of the first annular sleeve and one surface of each of the second annular sleeves towards the punch are arc-shaped; wherein the large thin-walled part with a curved surface has a diameter of more than 3000 mm and a thickness of 10 mm; and wherein the second annular sleeves comprise three second annular sleeves, and the three second annular sleeves have a common axis and have different radii.

2. The forming device for a large thin-walled part with a curved surface according to claim 1, wherein the first driving oil cylinders comprise two driving oil cylinders, and the second driving oil cylinders comprise two driving oil cylinders; the two first driving oil cylinders are symmetrically arranged relative to the common axis; the two second driving oil cylinders are symmetrically arranged relative to the common axis.

3. A forming method for a large thin-walled part with a curved surface, which utilizes the forming device for a large thin-walled part with a curved surface according to claim 2, wherein the forming method comprises the following steps:

step 1, a sheet blank is placed on an upper surface of the die, and a top surface of the first annular sleeve and top surfaces of the second annular sleeves abut against the sheet blank;

step 2, the press drives the connected blank holder to move downwards to press the sheet blank and apply an initial blank holding force;

step 3, the press drives the punch to move downwards, wherein the punch stops moving after being in contact with the sheet blank;

step 4, with the hydraulic system, the first driving oil cylinders and the second driving oil cylinders generate a pushing force to push the first annular sleeve and the second annular sleeves to support the sheet blank such that the blank sheet deforms upwards;

step 5, the press drives the punch to move downwards such that the sheet blank deforms downwards and the second annular sleeves forcedly move downwards;

step 6, deep drawing the sheet blank by driving the punch to move downwards until the sheet blank is in contact with the first annular sleeve; the hydraulic system increases the pressure of a lower cavity of the first driving oil cylinders such that the first annular sleeve pushes the sheet blank to deform upwards, and a portion of the sheet blank in a suspended area is leaned on the punch to form a deep drawbead; therefore, wrinkling is prevented in the suspended area;

step 7, after the deep drawing is completed, the hydraulic system controls the first driving oil cylinders and the second driving oil cylinders such that the first annular sleeve and the second annular sleeves return to the initial positions; the top surface of the first annular sleeve and the top surfaces of the second annular sleeves are leveled with a top surface of the die.

4. The forming method for a large thin-walled part with a curved surface according to claim 3, wherein the press drives the blank holder to apply an initial blank holding force to the sheet blank, and a unit blank holding force on a pressing area is in the range of 1-2 MPa.

5. The forming device for a large thin-walled part with a curved surface according to claim 1, wherein the first driving oil cylinders and the second driving oil cylinders are arranged on the lower die plate.

6. A forming method for a large thin-walled part with a curved surface, which utilizes the forming device for a large thin-walled part with a curved surface according to claim 5, wherein the forming method comprises the following steps:

step 1, a sheet blank is placed on an upper surface of the die, and a top surface of the first annular sleeve and top surfaces of the second annular sleeves abut against the sheet blank;

step 2, the press drives the connected blank holder to move downwards to press the sheet blank and apply an initial blank holding force;

step 3, the press drives the punch to move downwards, wherein the punch stops moving after being in contact with the sheet blank;

step 4, with the hydraulic system, the first driving oil cylinders and the second driving oil cylinders generate a pushing force to push the first annular sleeve and the second annular sleeves to support the sheet blank such that the blank sheet deforms upwards;

step 5, the press drives the punch to move downwards such that the sheet blank deforms downwards and the second annular sleeves forcedly move downwards;

step 6, deep drawing the sheet blank by driving the punch to move downwards until the sheet blank is in contact with the first annular sleeve; the hydraulic system increases the pressure of a lower cavity of the first driving oil cylinders such that the first annular sleeve pushes the sheet blank to deform upwards, and a portion of the sheet blank in a suspended area is leaned on the punch to form a deep drawbead; therefore, wrinkling is prevented in the suspended area;

step 7, after the deep drawing is completed, the hydraulic system controls the first driving oil cylinders and the second driving oil cylinders such that the first annular sleeve and the second annular sleeves return to the initial positions; the top surface of the first annular sleeve and the top surfaces of the second annular sleeves are leveled with a top surface of the die.

7. The forming method for a large thin-walled part with a curved surface according to claim 6, wherein the press drives the blank holder to apply an initial blank holding force to the sheet blank, and a unit blank holding force on a pressing area is in the range of 1-2 MPa.

8. The forming device for a large thin-walled part with a curved surface according to claim 1, wherein a shape of an axial section of the first annular sleeve is consistent with a shape of an axial section of the second annular sleeve.

9. A forming method for a large thin-walled part with a curved surface, which utilizes the forming device for a large thin-walled part with a curved surface according to claim 8, wherein the forming method comprises the following steps:

step 1, a sheet blank is placed on an upper surface of the die, and a top surface of the first annular sleeve and top surfaces of the second annular sleeves abut against the sheet blank;

step 2, the press drives the connected blank holder to move downwards to press the sheet blank and apply an initial blank holding force;

step 3, the press drives the punch to move downwards, wherein the punch stops moving after being in contact with the sheet blank;

step 4, with the hydraulic system, the first driving oil cylinders and the second driving oil cylinders generate a pushing force to push the first annular sleeve and the second annular sleeves to support the sheet blank such that the blank sheet deforms upwards;

step 5, the press drives the punch to move downwards such that the sheet blank deforms downwards and the second annular sleeves forcedly move downwards;

step 6, deep drawing the sheet blank by driving the punch to move downwards until the sheet blank is in contact with the first annular sleeve; the hydraulic system increases the pressure of a lower cavity of the first driving oil cylinders such that the first annular sleeve pushes the sheet blank to deform upwards, and a portion of the sheet blank in a suspended area is leaned on the punch to form a deep drawbead; therefore, wrinkling is prevented in the suspended area;

step 7, after the deep drawing is completed, the hydraulic system controls the first driving oil cylinders and the second driving oil cylinders such that the first annular sleeve and the second annular sleeves return to the initial positions; the top surface of the first annular sleeve and the top surfaces of the second annular sleeves are leveled with a top surface of the die.

10. The forming method for a large thin-walled part with a curved surface according to claim 9, wherein the press drives the blank holder to apply an initial blank holding force to the sheet blank, and a unit blank holding force on a pressing area is in the range of 1-2 MPa.

11. The forming device for a large thin-walled part with a curved surface according to claim 1, a contact area of the blank holder and a sheet blank, or a contact area of the die and the sheet blank are filleted.

12. A forming method for a large thin-walled part with a curved surface, which utilizes the forming device for a large thin-walled part with a curved surface according to claim 11, wherein the forming method comprises the following steps:

step 1, a sheet blank is placed on an upper surface of the die, and a top surface of the first annular sleeve and top surfaces of the second annular sleeves abut against the sheet blank;

step 2, the press drives the connected blank holder to move downwards to press the sheet blank and apply an initial blank holding force;

step 3, the press drives the punch to move downwards, wherein the punch stops moving after being in contact with the sheet blank;

step 4, with the hydraulic system, the first driving oil cylinders and the second driving oil cylinders generate a pushing force to push the first annular sleeve and the second annular sleeves to support the sheet blank such that the blank sheet deforms upwards;

step 5, the press drives the punch to move downwards such that the sheet blank deforms downwards and the second annular sleeves forcedly move downwards;

step 6, deep drawing the sheet blank by driving the punch to move downwards until the sheet blank is in contact with the first annular sleeve; the hydraulic system increases the pressure of a lower cavity of the first driving oil cylinders such that the first annular sleeve pushes the sheet blank to deform upwards, and a portion of the sheet blank in a suspended area is leaned on the punch to form a deep drawbead; therefore, wrinkling is prevented in the suspended area;

step 7, after the deep drawing is completed, the hydraulic system controls the first driving oil cylinders and the second driving oil cylinders such that the first annular sleeve and the second annular sleeves return to the initial positions; the top surface of the first annular sleeve and the top surfaces of the second annular sleeves are leveled with a top surface of the die.

13. The forming method for a large thin-walled part with a curved surface according to claim 12, wherein the press drives the blank holding to apply an initial blank holding force to the sheet blank, and a unit blank holding force on a pressing area is in the range of 1-2 MPa.

14. A forming method for a large thin-walled part with a curved surface, which utilizes the forming device for a large thin-walled part with a curved surface according to claim 1, wherein the forming method comprises the following steps:

step 1, a sheet blank is placed on an upper surface of the die, and a top surface of the first annular sleeve and top surfaces of the second annular sleeves abut against the sheet blank;

step 2, the press drives the connected blank holder to move downwards to press the sheet blank and apply an initial blank holding force;

step 3, the press drives the punch to move downwards, wherein the punch stops moving after being in contact with the sheet blank;

step 4, with the hydraulic system, the first driving oil cylinders and the second driving oil cylinders generate a pushing force to push the first annular sleeve and the second annular sleeves to support the sheet blank such that the blank sheet deforms upwards;

step 5, the press drives the punch to move downwards such that the sheet blank deforms downwards and the second annular sleeves forcedly move downwards;

step 6, deep drawing the sheet blank by driving the punch to move downwards until the sheet blank is in contact with the first annular sleeve; the hydraulic system increases the pressure of a lower cavity of the first driving oil cylinders such that the first annular sleeve pushes the sheet blank to deform upwards, and a portion of the sheet blank in a suspended area is leaned on the punch to form a deep drawbead; therefore, wrinkling is prevented in the suspended area;

step 7, after the deep drawing is completed, the hydraulic system controls the first driving oil cylinders and the second driving oil cylinders such that the first annular sleeve and the second annular sleeves return to the initial positions; the top surface of the first annular sleeve and the top surfaces of the second annular sleeves are leveled with a top surface of the die.

15. The forming method for a large thin-walled part with a curved surface according to claim 14, wherein the press drives the blank holder to apply an initial blank holding force to the sheet blank, and a unit blank holding force on a pressing area is in the range of 1-2 MPa.

* * * * *